US011719481B2

(12) United States Patent
Martin

(10) Patent No.: US 11,719,481 B2
(45) Date of Patent: Aug. 8, 2023

(54) CURVED-BOTTOM CONTAINER

(71) Applicant: Michael B. Martin, Houston, TX (US)

(72) Inventor: Michael B. Martin, Houston, TX (US)

( * ) Notice: Subject to any disclaimer, the term of this patent is extended or adjusted under 35 U.S.C. 154(b) by 0 days.

(21) Appl. No.: 16/000,408

(22) Filed: Jun. 5, 2018

(65) Prior Publication Data

US 2019/0063816 A1 Feb. 28, 2019

Related U.S. Application Data

(60) Provisional application No. 62/605,683, filed on Aug. 23, 2017.

(51) Int. Cl.

| | |
|---|---|
| ***A47J 47/16*** | (2006.01) |
| ***F25D 3/08*** | (2006.01) |
| ***F25D 31/00*** | (2006.01) |
| ***A47G 23/02*** | (2006.01) |
| *F25D 23/08* | (2006.01) |

(52) U.S. Cl.

CPC ..... *F25D 3/08* (2013.01); *A47G 23/0241* (2013.01); *F25D 31/007* (2013.01); *F25D 23/08* (2013.01); *F25D 2331/803* (2013.01); *F25D 2400/18* (2013.01); *F25D 2500/02* (2013.01)

(58) Field of Classification Search

CPC ..... B65D 2207/00; F25D 3/08; F25D 31/007; F25D 23/08; F25D 2331/803; F25D 2400/18; A47G 23/0241

USPC ..... 220/608, 600, 660, 661, 669; 215/379, 215/380, 382

See application file for complete search history.

(56) References Cited

U.S. PATENT DOCUMENTS

| | | | | |
|---|---|---|---|---|
| 3,808,081 | A * | 4/1974 | Okuhara | B44F 11/00 362/280 |
| 4,255,944 | A * | 3/1981 | Gardner | F25D 31/007 D7/603 |
| D493,671 | S * | 8/2004 | Lebowitz | D7/583 |
| D549,913 | S * | 8/2007 | Bergman | D32/53 |
| 7,882,971 | B2 | 2/2011 | Kelley et al. | |
| 8,397,519 | B2 | 3/2013 | Loibl et al. | |
| D697,281 | S | 1/2014 | Bergman et al. | |
| D796,910 | S * | 9/2017 | Ritch | D7/584 |
| 9,845,171 | B2 * | 12/2017 | Conway | B65D 25/2882 |
| 2003/0173877 | A1 | 9/2003 | Pleiman et al. | |
| 2003/0183628 | A1 | 10/2003 | Barr | |
| 2005/0078472 | A1 | 4/2005 | Wiest | |
| 2011/0180547 | A1 * | 7/2011 | Park | A47J 47/16 220/574 |

OTHER PUBLICATIONS

International Search Report and Written Opinion for Application No. PCT/US2018/047098 dated Nov. 9, 2018.

* cited by examiner

*Primary Examiner* — John K Fristoe, Jr.
*Assistant Examiner* — Elizabeth J Volz
(74) *Attorney, Agent, or Firm* — Tumey L.L.P.; Eric M. Adams; Tod T. Tumey

(57) ABSTRACT

A container apparatus may comprise two sides, wherein the two sides each have curved edges and substantially flat surfaces, a front, a back, wherein the back is wider than the front, a curved bottom, and an aperture. The curved bottom of the container apparatus may allow for an improved ability to insert a bottle into a plurality of ice in the container apparatus with increased surface contact between the bottle and the plurality of ice.

14 Claims, 4 Drawing Sheets

CURVED-BOTTOM CONTAINER

This Application claims priority to a Provisional Application Ser. No. 62/605,683 filed Aug. 23, 2017.

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of the Disclosure

This disclosure relates to a field for a curved-bottom container that may be capable of holding ice or ice with one or more bottles. The improved container allows for an increased surface contact between the one or more bottles and the ice.

Background of the Disclosure

Currently, containers such as wine buckets hold ice for the purpose of chilling bottles of wine—or perhaps bottles containing other beverages. In some instances, a bottle may be placed in the wine bucket first with ice poured into the wine bucket onto the bottle. Although this may chill the bottle initially, a problem may arise when the bottle is removed from the wine bucket in order to fill glasses. The problem may be that it is difficult to submerge the bottle into the ice in the wine bucket in a manner that creates the same amount of surface contact between the ice and bottle that was achieved initially. In instances where ice is poured into the wine bucket initially, this problem may be encountered in the first attempt to insert the bottle into the ice.

Thus, there is a need for a container that may hold ice and one or more bottles while at the same time allow for an improved ability to insert the bottle into the ice in such a way as to improve surface contact between the bottle and the ice.

BRIEF SUMMARY OF SOME OF THE PREFERRED EMBODIMENTS

These and other needs in the art may be addressed in embodiments by a curved-bottom container.

A container apparatus may comprise two sides, wherein the two sides each have curved edges and substantially flat surfaces, a front, a back, wherein the back is wider than the front, a curved bottom, and an aperture.

A container apparatus may comprise two sides, wherein the two sides each have curved edges and substantially flat surfaces, a front, a back, wherein the back is wider than the front, a curved bottom, an aperture, and a support structure.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

The present disclosure relates to embodiments of a container apparatus. More particularly, embodiments of a container apparatus with a curved bottom is disclosed. In embodiments, a container apparatus may be used for chilling bottles of wine or other beverages using a plurality of ice. In embodiments, a container apparatus with a curved bottom may allow for an improved ability to insert a bottle into a plurality of ice in the container apparatus with increased surface contact between the bottle and the plurality of ice.

Figure 1:
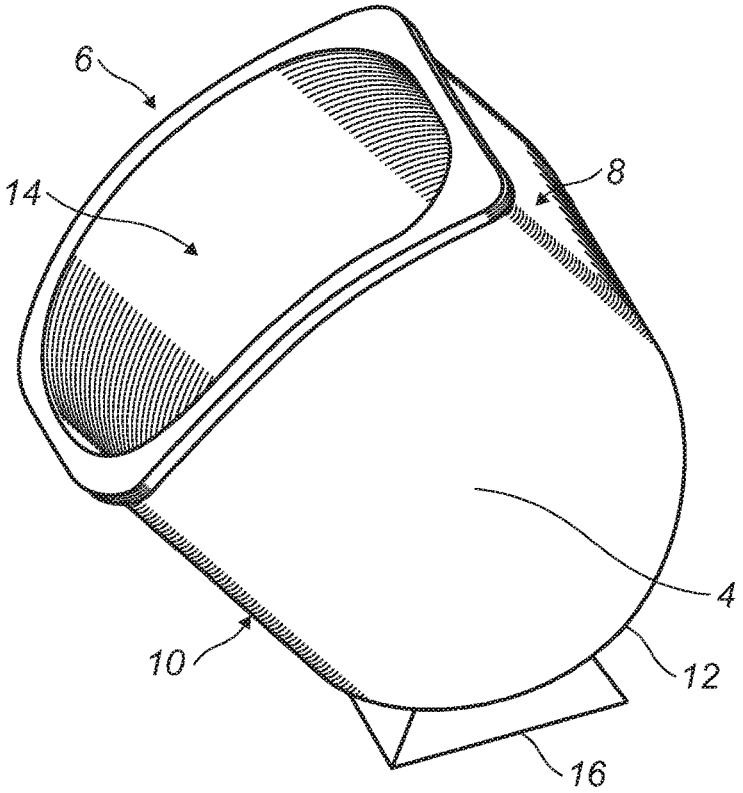
FIG. 1 illustrates a perspective view of an embodiment of a container.

FIG. 1 illustrates a perspective view of an embodiment of a container 2 comprising a first side 4, a second side 6, a front 8, a back 10, a curved bottom 12, and an aperture 14. Container 2 has both an interior surface and an exterior surface. In embodiments, the thickness of container 2 may preferably be about 3 mm. In embodiments, the thickness of container 2 may vary at different parts of container 2 as well as among different embodiments of container 2. In embodiments, the interior surface of container 2 may not contain any straight edges except possibly the edges of aperture 14. In embodiments, container 2 may be made of plastic, but container 2 may also be made from steel or any other solid material capable of holding a liquid. Further, in embodiments, container 2 may be double-layered for thermal insulation purposes. Additionally, in embodiments, a fabric or foam sleeve may be placed on the exterior surface of container 2 to provide thermal insulation. Container 2 may also comprise a support structure 16, as illustrated in FIG. 1. In embodiments, support structure 16 may be a base, a stand, an indentation, and/or legs. In embodiments, support structure 16 may also be a stand from which container 2 hangs. Further, in embodiments, support structure 16 may also be a stand from which container 2 hangs off the side of a table or other surface. In embodiments, container 2 may be maintained at a 45-degree angle between back 8 and the surface upon which container 2 is placed. Alternatively, container 2 may be positioned at other angles relative to the surface upon which container 2 is placed for use. In other embodiments, container 2 may be hung at a 45-degree angle or any other angle relative to the floor or ground. In embodiments, container 2 may also be comprised of handles. In embodiments, container 2 may be further comprised of handles that form all or part of support structure 16. Additionally, in embodiments, support structure 16 may be more than one base, indentation, or stand.

Figure 2:
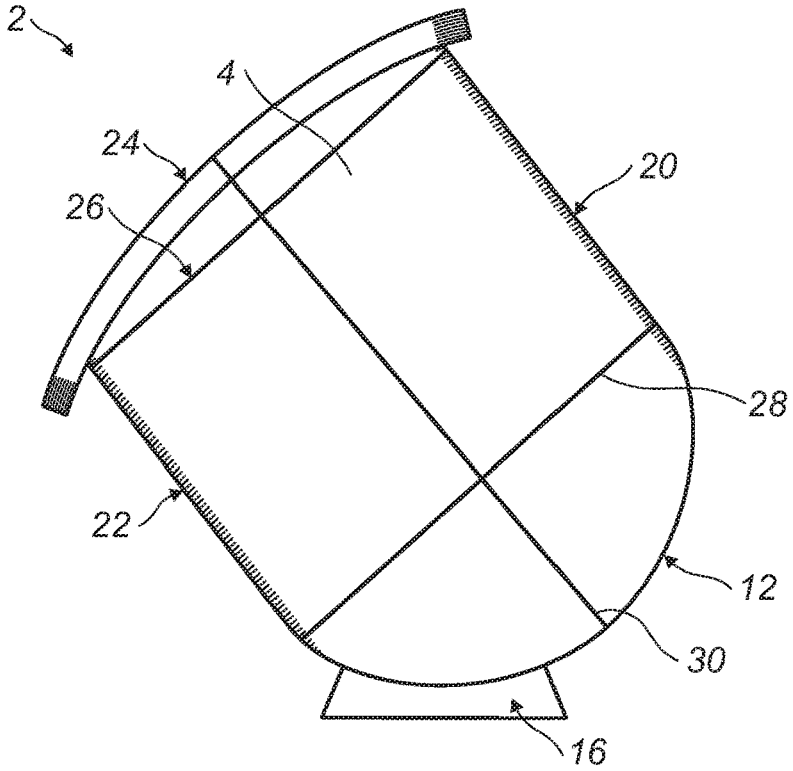
FIG. 2 illustrates a side view of an embodiment of a container showing a first side.

FIG. 2 illustrates a side view of an embodiment of container 2 showing first side 4. In embodiments, first side 4 may have a substantially flat surface with an exterior surface and an interior surface. In embodiments, a first edge 20 may have a length ranging from about 130 mm to about 150 mm, and preferably about 139 mm from the top of first edge 20 to the beginning of curved bottom 12. Further, in embodiments, a second edge 22 may have a length ranging from about 145 mm to about 165 mm, and preferably about 154 mm from the top of second edge 22 to the beginning of the curved bottom 12. Additionally, in embodiments, first edge 20 may correspond to a center section 44 of front 8, and second edge 22 may correspond to a center section 50 of back 10.

FIG. 2 further illustrates a top edge 24 of first side 4. In embodiments, top edge 24 may have a curved shape gently sloping from the top of first edge 20 to the top of second edge 22. In embodiments, top edge 24 may have a length ranging from about 205 mm to about 225 mm, preferably about 214 mm. In embodiments, the distance from the top of first edge 20 across first side 4 to second edge 22 may have a length ranging from about 200 mm to about 220 mm, preferably about 210 mm straight across, as shown in FIG. 2 and illustrated as a line 26, which is perpendicular to second edge 22 and terminates at the top of first edge 20. Also, in embodiments, the distance from center section 44 of front 8 to center section 50 of back 10 across first side 4, along the same path as line 26 may have a length ranging from about 265 mm to about 285 mm, preferably about 275 mm, which takes into account the curves as first side 4 transitions into front 8 and back 10. In embodiments, the distance from the bottom of first edge 20 across first side 4 to the bottom of second edge 22 may have a length ranging from about 190 mm to about 210 mm, preferably about 200 mm straight across, as shown in FIG. 2 and illustrated as a line 28, which is about parallel to line 26. Further, the distance from center section 44 of front 8 to center section 50 of back 10 across first side 4, along the same path as line 28 may have a length ranging from about 240 mm to about 260 mm, preferably about 250 mm, which takes into account the curves as first side 4 transitions into front 8 and back 10. Thus, in embodiments, first side 4 may narrow from top edge 24 to line 28. In embodiments, the distance from about the middle of top edge 24 to about the middle of curved bottom 12 may have a length ranging from about 240 mm to about 260 mm, preferably about 247 mm, as shown in FIG. 2 and illustrated as line 30. Further, the segment of line 30 between curved bottom 12 and line 28 may have a length ranging from about 65 mm to about 75 mm, preferably about 72 mm. Also, the segment of second edge 22 between top edge 24 and line 26 may have a length ranging from about 10 mm to about 18 mm, preferably about 14.7 mm. Additionally, in embodiments, curved bottom 12 from about the bottom of first edge 20 to about the bottom of second edge 22 may have a length ranging from about 280 mm to about 300 mm, preferably about 290 mm.

Figure 3:
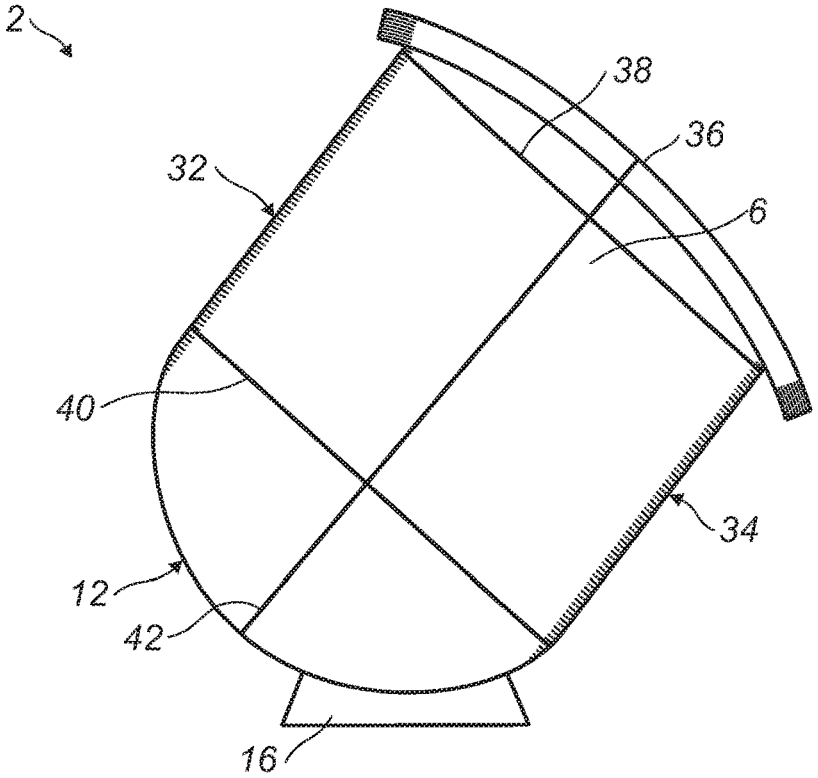
FIG. 3 illustrates a side view of an embodiment of a container showing a second side.

FIG. 3 illustrates a side view of an embodiment of container 2 showing second side 6. It should be noted that in embodiments, the features and dimensions of second side 6 are the same as first side 4. In embodiments, second side 6 may have a substantially flat surface with an exterior surface and an interior surface. In embodiments, a first edge 32, which corresponds to first edge 20, may have a length ranging from about 130 mm to about 150 mm, and preferably about 139 mm from the top of first edge 32 to the beginning of curved bottom 12. Further, in embodiments, a second edge 34 may have a length ranging from about 145 mm to about 165 mm, and preferably about 154 mm from the top of second edge 34 to the beginning of the curved bottom 12. Additionally, in embodiments, first edge 32 may correspond to a center section 44 of front 8, and second edge 34 may correspond to a center section 50 of back 10.

FIG. 3 further illustrates a top edge 36, which corresponds to top edge 24, of second side 6. In embodiments, top edge 36 may have a curved shape gently sloping from the top of first edge 32 to the top of second edge 34. In embodiments, top edge 36 may have a length ranging from about 205 mm to about 225 mm, preferably about 214 mm. In embodiments, the distance from the top of first edge 32 across second side 6 to second edge 34 may have a length ranging from about 200 mm to about 220 mm, preferably about 210 mm straight across, as shown in FIG. 3 and illustrated as a line 38, which is perpendicular to second edge 34 and terminates at the top of first edge 32. Also, in embodiments, the distance from center section 44 of front 8 to center section 50 of back 10 across second side 6, along the same path as line 38 may have a length ranging from about 265 mm to about 285 mm, preferably about 275 mm, which takes into account the curves as second side 6 transitions into front 8 and back 10. In embodiments, the distance from the bottom of first edge 32 across second side 6 to the bottom of second edge 34 may have a length ranging from about 190 mm to about 210 mm, preferably about 200 mm straight across, as shown in FIG. 3 and illustrated as a line 40, which is about parallel to line 38. Further, the distance from center section 44 of front 8 to center section 50 of back 10 across second side 6, along the same path as line 40 may have a length ranging from about 240 mm to about 260 mm, preferably about 250 mm, which takes into account the curves as second side 6 transitions into front 8 and back 10. Thus, in embodiments, second side 6 may narrow from top edge 36 to line 40. In embodiments, the distance from about the middle of top edge 36 to about the middle of curved bottom 12 may have a length ranging from about 240 mm to about 260 mm, preferably about 247 mm, as shown in FIG. 3 and illustrated as line 42. Further, the segment of line 42 between curved bottom 12 and line 40 may have a length ranging from about 65 mm to about 75 mm, preferably about 72 mm. Also, the segment of second edge 34 between top edge 36 and line 38 may have a length ranging from about 10 mm to about 18 mm, preferably about 14.7 mm. Additionally, in embodiments, curved bottom 12 from about the bottom of first edge 32 to about the bottom of second edge 34 may have a length ranging from about 280 mm to about 300 mm, preferably about 290 mm.

Figure 4:
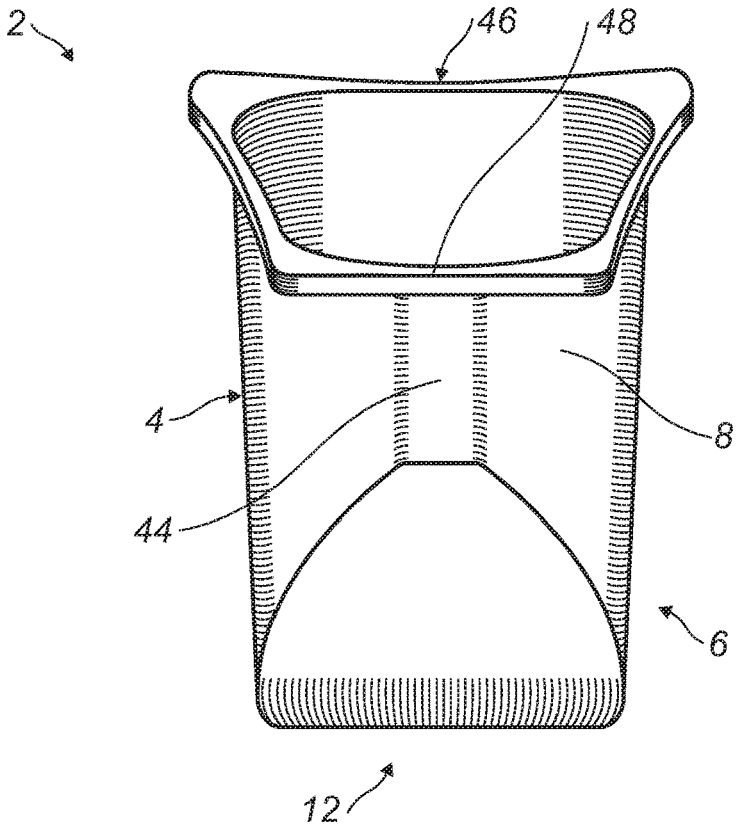
FIG. 4 illustrates a front view of an embodiment of a container.

FIG. 4 illustrates a front view of an embodiment of container 2. In embodiments, front 8 has a center section 44, which may have a substantially flat surface. In embodiments, center section 44 may have a horizontal length ranging from about 25 mm to about 35 mm, preferably about 30 mm, and center section 44 may have a vertical length ranging from about 130 mm to about 150 mm, preferably about 140 mm, which terminates at the beginning of curved bottom 12. As stated above, center section 44 corresponds to first edge 20 of first side 4 and first edge 32 of second side 6. In embodiments, front 8 may have a curved top edge 46, as shown in FIG. 4. In embodiments, an illustrated line 48, as shown in FIG. 4, may have a length ranging from about 110 mm to about 130 mm, preferably about 120 mm. Further, in embodiments, the bottom width of front 8 may have a length ranging from about 105 mm to about 120 mm, preferably about 112 mm. Thus, front 8 may narrow from top edge 46 to the bottom of front 8. In embodiments, the entire vertical length of front 8 may have a length ranging from about 210 mm to about 230 mm, preferably about 220 mm.

Figure 5:
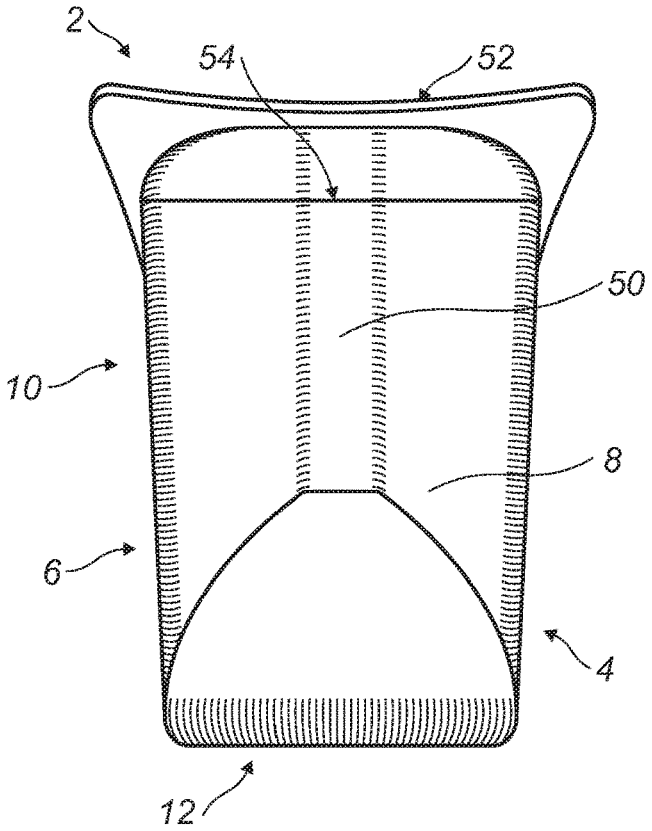
FIG. 5 illustrates a back view of an embodiment of a container.

FIG. 5 illustrates a back view of an embodiment of container 2. In embodiments, back 10 has a center section 50, which may have a substantially flat surface. In embodiments, center section 50 may have a horizontal length ranging from about 25 mm to about 35 mm, preferably about 30 mm, and center section 50 may have a vertical length ranging from about 145 mm to about 160 mm, preferably about 153 mm, which terminates at the beginning of curved bottom 12. As stated above, center section 50 corresponds to second edge 22 of first side 4 and second edge 34 of second side 6. In embodiments, back 10 may have a curved top edge 52, as shown in FIG. 5. In embodiments, an illustrated line 54, as shown in FIG. 5, may have a length ranging between about 140 mm to about 160 mm, preferably about 150 mm. Further, in embodiments, the bottom width of back 10 may have a length ranging from about 115 mm to about 135 mm, preferably about 125 mm. Thus, back 10 may narrow from top edge 52 to the bottom of back 10. In embodiments, the entire vertical length of back 10 may have a length ranging between about 230 mm to about 250 mm, preferably about 240 mm.

Figure 6:
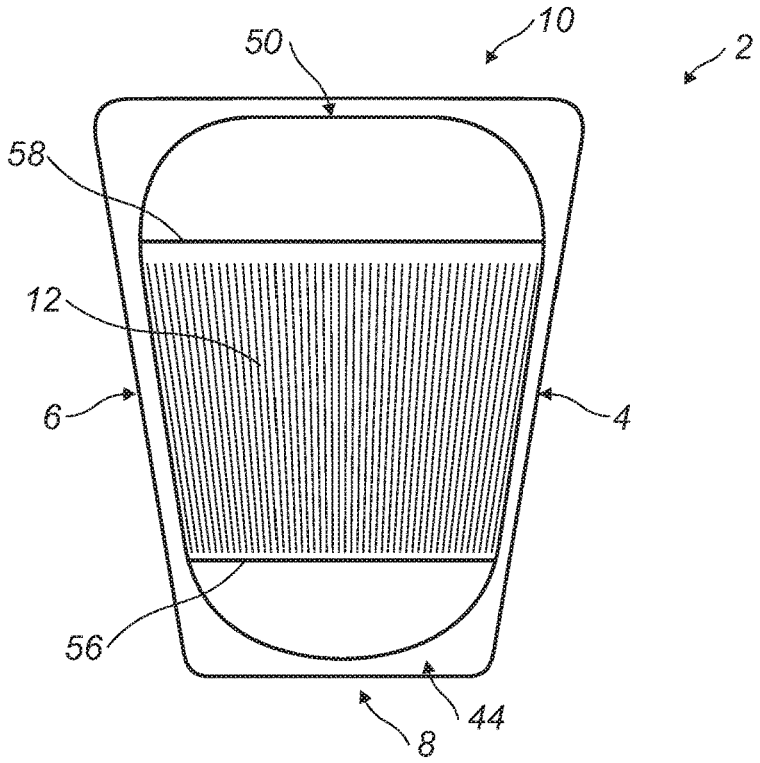
FIG. 6 illustrates a bottom view of an embodiment of a container.

FIG. 6 illustrates a bottom view of an embodiment of container 2. In embodiments, curved bottom 12 begins at the bottom edge of center section 44 and continues around the bottom of container 2 to the bottom edge of center section 50, a distance ranging from about 280 mm to about 300 mm, preferably about 290 mm. In embodiments, the length of curved bottom 12 from center section 44 to center section 50, without accounting for curvature, may have a length ranging from about 190 mm to about 210 mm, preferably about 200 mm. In embodiments, an illustrated line 56, as shown in FIG. 6, may have a length ranging from about 105 mm to about 118 mm, preferably about 112 mm. Further, in embodiments, an illustrated line 58, as shown in FIG. 6, may have a length ranging from about 120 mm to about 130 mm, preferably about 125 mm. Thus, curved bottom 12 may widen from center section 44 to center section 50.

Figure 7:
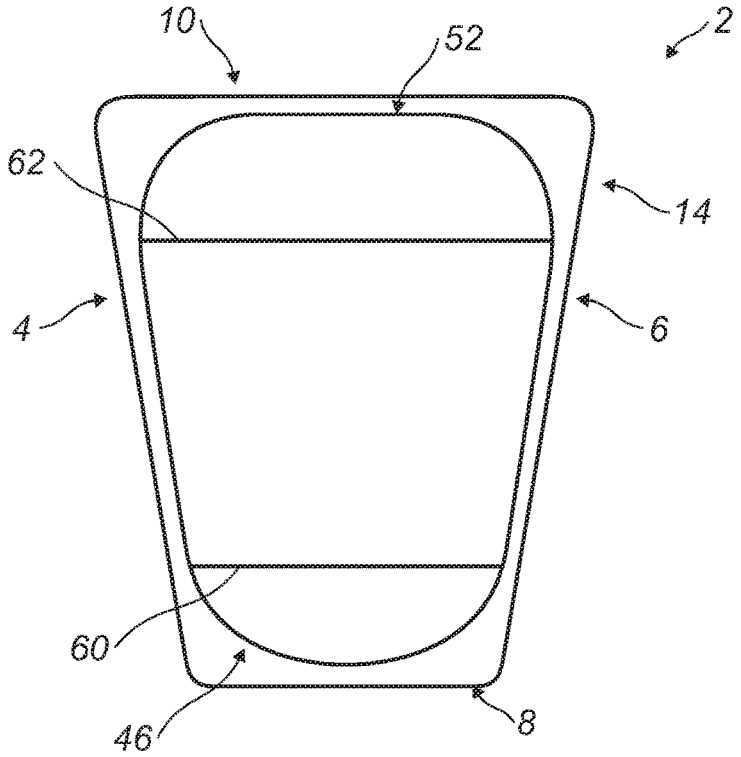
FIG. 7 illustrates a top view of an embodiment of a container.

FIG. 7 illustrates a top view of an embodiment of container 2. In embodiments, aperture 14 is bounded by first side 4, second side 6, front 8, and back 10. In embodiments, at the front end of aperture 14, an illustrated line 60, as shown in FIG. 7, may have an interior length ranging from about 115 mm to about 125 mm, preferably about 120.6 mm. Further, in embodiments, at the back end of aperture 14, an illustrated line 62, as shown in FIG. 7, may have an interior length ranging from about 130 mm to about 140 mm, preferably about 134.5 mm. Thus, in embodiments, aperture 14 may widen moving from front 8 to back 10. Further, in embodiments, the top of first side 4 and the top of second side 6 may appear substantially straight.

Figure 8:
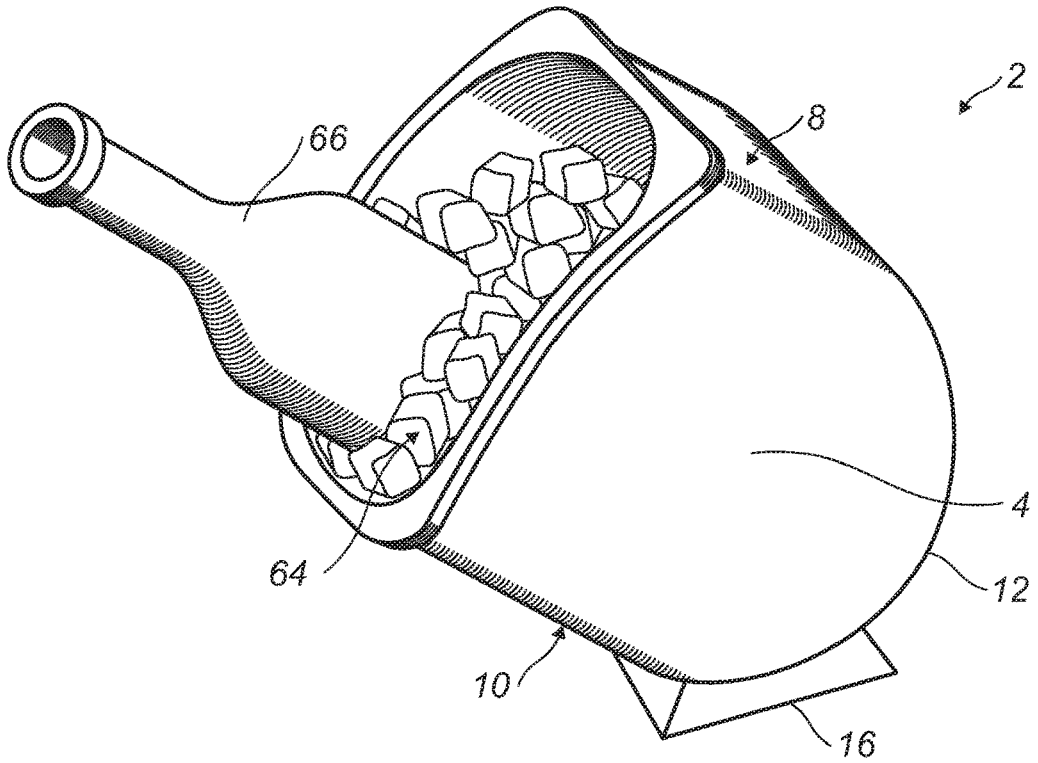
FIG. 8 illustrates a perspective view of a container with a plurality of ice cubes and a bottle.

FIG. 8 illustrates a perspective view of container 2 with a plurality of ice cubes 64 and a bottle 66. In embodiments, the plurality of ice 64 may be placed in container 2 initially. Bottle 66 may then be placed inside container 2, preferably along the interior surface of back 10. As bottle 66 contacts the plurality of ice 64, the force of bottle 66 against the plurality of ice 64 may force the plurality of ice 64 to be displaced, thus making room for bottle 66. In embodiments, given that there may be no straight edges along the interior surfaces of first side 4, second side 6, or curved bottom 12, there may be no straight edges for the plurality of ice 64 to brace against. As bottle 66 reaches its resting position at the bottom of curved bottom 12 along back 10, the plurality of ice 64 partially envelops bottle 66 as the portion of the plurality of ice 64 that is displaced is forced by gravity to partially envelop bottle 66. Thus, the plurality of ice 64 envelops bottle 66 achieving an improved amount of surface contact between bottle 66 and the plurality of ice 64 by use of displacement and gravity. In embodiments, bottle 66 may be removed and inserted into container 2 and the plurality of ice 64 repeatedly. Alternatively, in embodiments, bottle 66 may initially be placed in container 2 before the plurality of ice 64 is placed in container 2.

Furthermore, there may be additional embodiments in which container 2 comprises merely a receptacle for holding plurality of ice 64. In such an embodiment, container 2 may also comprise a lid. Further, in additional embodiments, container 2 may comprise a support structure 16, which allows for container 2 to be positioned at either a 45-degree angle or a 90-degree angle. Further, in embodiments, support structure 16 may comprise a tray with an aperture into which container 2 may be placed such that container 2 may be positioned as a 45-degree angle.

Although the present invention and its advantages have been described in detail, it should be understood that various changes, substitutions and alterations may be made herein without departing from the spirit and scope of the invention as defined by the appended claims. The dimensions identified for the preferred and other embodiments in this detailed description are merely for illustrative purposes and are not meant to limit the inventions to any particular embodiments, features, or dimensions.

Persons of skill in the art will recognize various combinations and orders of the above details of the apparatus presented herein. While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A container apparatus comprising:

two sides, wherein the two sides each comprise substantially flat surfaces;

a front comprising a first substantially flat center section;

a back comprising a second substantially flat center section, wherein the back is wider than the front;

a completely curved top edge, wherein the top edge comprises a concave surface relative to an interior of the container apparatus; and a continuously and completely curved bottom extending from the front to the back, wherein the continuously and completely curved bottom is a concave surface relative to the interior of the container apparatus, wherein the two sides, the front, the back, and the continuously and completely curved bottom form an aperture comprising two internal side surfaces corresponding to the two sides surfaces, a front internal surface and a back internal surface corresponding to the front and the back, and a continuously and completely curved internal surface corresponding to the continuously and completely curved bottom, wherein the size of the aperture allows for a bottle to be placed in the container apparatus.

2. The apparatus of claim 1, wherein the height of the front is shorter than the height of the back.

3. The apparatus of claim 1, wherein the back and the front rest at about a 45-degree angle to a surface upon which the container apparatus is placed.

4. The apparatus of claim 1, wherein the aperture has a curved front and back edges with substantially straight sides.

5. The apparatus of claim 1, wherein the curved bottom is narrower than the aperture.

6. The apparatus of claim 1, further comprising a plurality of ice disposed within the interior.

7. The apparatus of claim 6, wherein the curved bottom improves the ability for the bottle to be placed within the container apparatus among the plurality of ice.

8. A container apparatus comprising:

two sides, wherein the two sides each comprise substantially flat surfaces;

a front comprising a first substantially flat center section;

a back comprising a second substantially flat center section, wherein the back is wider than the front;

a completely curved top edge, wherein the top edge comprises a concave surface relative to an interior of the container apparatus; and a continuously and completely curved bottom extending from the front to the back, wherein the continuously and completely curved bottom is a concave surface relative to the interior of the container apparatus, wherein the two sides, the front, the back, and the continuously and completely curved bottom form an aperture comprising two internal side surfaces corresponding to the two sides surfaces, a front internal surface and a back internal surface corresponding to the front and the back, and a continuously and completely curved internal surface corresponding to the continuously and completely curved bottom, wherein the size of the aperture allows for a bottle to be placed in the container apparatus; and a support structure.

9. The apparatus of claim 8, wherein the height of the front is shorter than the height of the back.

10. The apparatus of claim 8, wherein the back and the front rest at about a 45-degree angle to a surface upon which the container apparatus is placed.

11. The apparatus of claim 8, wherein the aperture has a curved front and back edges with substantially straight sides.

12. The apparatus of claim 8, wherein the curved bottom is narrower than the aperture.

13. The apparatus of claim 8, further comprising a plurality of ice disposed within the interior.

14. The apparatus of claim 13, wherein the curved bottom improves the ability for the bottle to be placed within the container apparatus among the plurality of ice.

* * * * *